United States Patent [19]

Dolan

[11] Patent Number: 4,624,022

[45] Date of Patent: Nov. 25, 1986

[54] DEVICE FOR HOLDING A SHEET OR COVER IN POSITION ON THE SURFACE OF A WATER BED MATTRESS

[76] Inventor: Donald G. Dolan, 893 Ayrshire Ct., Frankfort, Ill. 60423

[21] Appl. No.: 733,500

[22] Filed: May 10, 1985

[51] Int. Cl.[4] ..... A47C 21/02

[52] U.S. Cl. ..... 5/508; 5/451; 24/72.5

[58] Field of Search ..... 5/451, 496, 498, 508, 5/460; 24/72.5

[56] References Cited

U.S. PATENT DOCUMENTS

| | | | |
|---|---|---|---|
| 4,040,133 | 8/1977 | Gilreath | 5/496 |
| 4,057,862 | 11/1977 | La Bianco | 5/460 |
| 4,521,970 | 6/1985 | Dester | 5/498 |
| 4,539,723 | 9/1985 | Hillsberry | 24/72.5 |

*Primary Examiner*—Alexander Grosz
*Attorney, Agent, or Firm*—Norman Lettvin

[57] ABSTRACT

A device for holding the corner of a sheet and/or cover in place on the surface of a water bed mattress is provided by a corner structure insertable under each corner of the mattress, to be supported and confined by the bottom support for the mattress and the upright side walls of the mattress confining frame. Each corner structure includes a diagonal brace member with mitered ends adapted to abut a pair of transverse side walls of the mattress confining frame, and to define a generally triangular space between the brace member and the adjacent frame corner. A mattress lifter, that is part of the device and is smaller than said triangular space, is hingedly mounted to the brace member and positioned in the triangular space. A handle means is secured to the mattress lifter and provides manual means for pivoting the mattress lifter about its hinge so as to raise the corner of the water bed mattress that is positioned thereabove. The mattress lifter may be provided with hooks or groove means constructed and arranged for receiving and holding retaining cords that extend from the mattress' sheet and/or cover, to facilitate providing a neat appearance to the made-up bed. The device may be made from any material, including wood elements joined by a piano hinge, or may be unitarily formed of molded plastic parts joined by a plastic hinge.

16 Claims, 9 Drawing Figures

DEVICE FOR HOLDING A SHEET OR COVER IN POSITION ON THE SURFACE OF A WATER BED MATTRESS

BACKGROUND OF THE INVENTION

1. Field Of The Invention

This invention relates to apparatus for maintaining bed clothes, such as a mattress cover and/or a bed sheet, on a water bed mattress, and provides structure to facilitate lifting a corner portion of a water bed mattress to facilitate assembly of a sheet or mattress cover onto the water bed mattress, or for removal of same from the water bed mattress.

2. Description Of The Prior Art

Form fitting sheets and mattress covers for use on ordinary mattresses are known which use an elastic member that is arranged to fit, or stretch, over and across a bottom portion of the mattress adjacent each corner. In other mattress coverings, a peripheral edge portion of the covering is tucked under the mattress to maintain the mattress coverings in a desired position attractively covering the top, or sleeping surface, of the mattress.

In water beds that include a liquid filled mattress in which the mattress is positioned on a bottom support surface and confined by a peripheral frame, with the side walls of the liquid filled mattress effectively surrounded, or confined by the inner surface of a surrounding frame, it is difficult for a person who is making up the water bed to get a hand, or hands, between the inner surface of the frame and the mattress to enable reaching to the bottom of the mattress. This is due, in part, to the considerable weight of the mattress of a water bed, and the difficulty of grasping the mattress to lift a corner portion of it upward to a position where the cover member, or bed sheet, may be fitted onto and under the lower edge of the water bed mattress.

Additionally, due to the yielding nature of a liquid filled mattress, and particularly water-filled mattresses, conventional elastic bottom corner engaging members or stays are difficult to maintain engaged with the mattress to maintain the bed clothes in their proper desired position on the mattress.

Various structures for handling mattresses and/or maintaining bed clothes on the mattress are disclosed in U.S. Pat. Nos. 1,035,222; 1,566,907; 2,291,444; 3,092,848; 4,089,075; 4,199,831; 4,228,555; 4,276,667 and 4,400,836.

None of the U.S. patents identified above show or suggest the novel structure and function of a corner device for a water bed such as disclosed herein, in which the corner device is constructed and arranged to serve as an aid in lifting a corner of a water bed mattress that is confined in its frame, and in which the lift member has retaining features provided thereon that afford easy engagement, or removal, of a sheet and/or a mattress pad to the corner device, and in which, upon lowering the lift member, serves to maintain the corner of the engaged mattress cover, or sheet, neatly and in its desired position.

SUMMARY OF THE INVENTION

A device for helping to hold in place a cover or sheet for a water bed mattress is provided. The device includes a position-maintaining brace member, a movable mattress support-and-lift member that is pivotally connected to the position-maintaining member, and grooves or brackets for engaging and holding attachment ties or strips on mattress covers or sheets are provided on the mattress support-and-lift member. An elongated, strap-like, lift member connected to the mattress support-and-lift member is provided for selectively raising a corner of the water bed mattress. The position-maintaining brace member is shaped and arranged to assume a relatively fixed position resting on a bottom support member of the water bed's frame and having each of its two ends braced against wall portions of the peripheral frame of the water bed. Each support-and-lift member is spaced from the water bed's frame to permit of easy movement thereof by the position-maintaining member. An elongated strap-like member is affixed to the hinged lift member and extends upwardly along the vertical wall of the water bed's frame to place an end of the strap in a readily accessible and normal graspable position.

Grasping the end of the strap and pulling upward on it causes the lift member to pivot upwardly with respect to the position-maintaining member and raises the corner of the water mattress overlying the lift member. The underside of the raised mattress support-and-lift member is exposed to make accessible bed sheet retaining means that are provided thereon, whereby while holding the support-and-lift member with one hand, the person making the bed can engage or disengage cord-like stays of a bed sheet or cover to respectively install or remove the sheets from that corner of the bed. In its normal use position the weight of the water bed mattress holds each position-maintaining member and its attached support-and-lift member in flat position on the water bed's support.

DETAILED DESCRIPTION OF THE INVENTION

Figure 1:
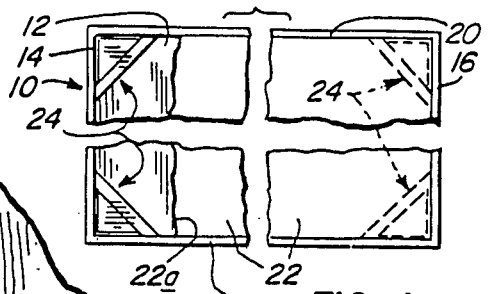
FIG. 1 illustrates generally, in reduced, fragmentary plan form, a rectangular frame for a water bed assembly that is equipped in each of its four corners with a device constructed in accord with the invention disclosed hereinafter.

There is shown in FIG. 1 a top plan view of a frame 10 for a water bed, the frame 10 being generally in the form of a rectangle. The frame includes a planar bottom support 12 whose edges are connected respectively to spaced, upright, shorter end walls 14 and 16 and spaced, upright longer side walls 18 and 20. Each end and side wall is substantially at right angles to each other where they meet at a vertical corner. A water-filled mattress, shown only in fragment in FIG. 1, is generally designated at 22. Supported on bottom support 12 in each of the four corners of frame 10 is a corner device 24 which embodies the invention herein. The two devices 24 at the left-hand end of frame 10 shown in FIG. 1 are shown in full lines because they are not shown covered by the mattress 22, while the two devices at the right-hand end of frame 10, as shown in FIG. 1, are shown in broken lines because they are covered by the water-filled mattress 22.

Figure 2:
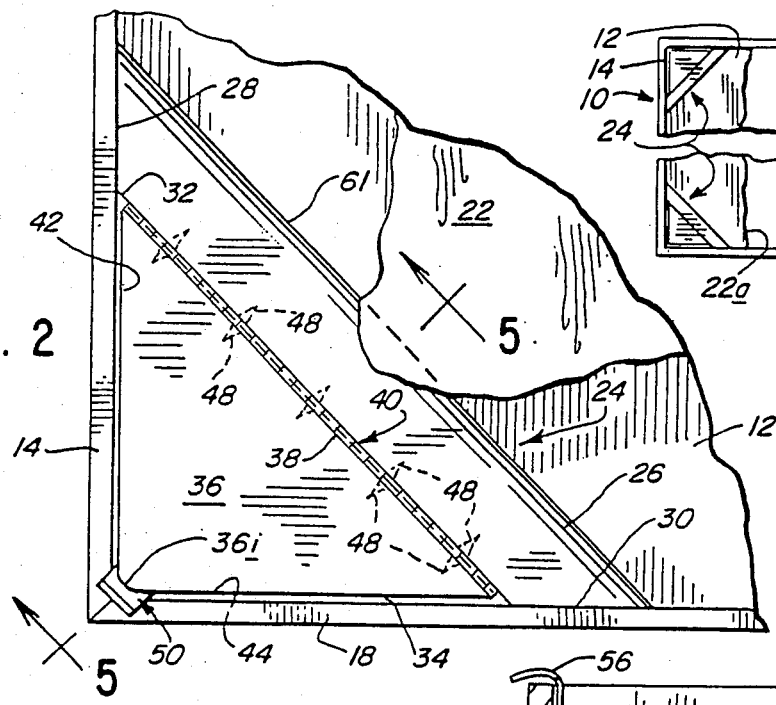
FIG. 2 is a fragmentary top plan view of a first preferred form of apparatus of this invention, showing the normal use position for the apparatus in one corner of a rectangular water bed frame.

Referring now.to the fragmentary, enlarged, top plan view in FIG. 2, one of the corner devices 24 that embodies the invention, is shown in that Figure in enlarged plan view. Each corner device 24 is of the same construction and includes an elongated, diagonal, brace member 26 with mitered, or beveled, ends 28 and 30, that are beveled at 45°, and are adapted respectively to engage and abut the inner surfaces of the frame's transverse walls 14 and 18 to provide a specific location for the brace 26. The wall edge 32 of brace member that is closest to the corner of the water bed's frame, formed by the intersection of walls 14 and 18, serves with walls 14 and 18, to provide a triangularly-shaped space 34.

Figure 5:
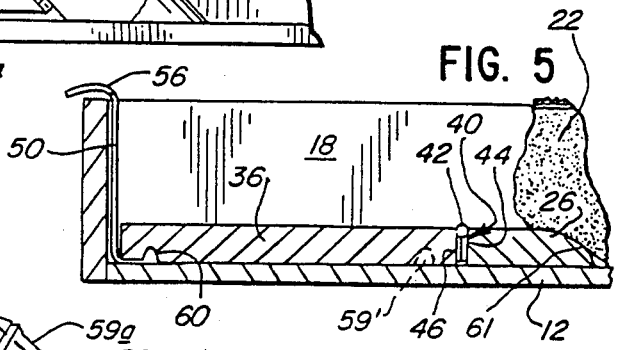
FIG. 5 is a cross-sectional view of the form of invention shown in FIGS. 2–4, and is taken substantially on the section line 5—5 of FIG. 2.

Positioned within the triangularly-shaped space 34 is a generally triangularly-shaped lifting member 36 that is part of the corner device 24. The triangularly-shaped lifting member 36, which may be made of wood, has a hypotenuse, or diagonal, wall edge 38 that is parallel to, but spaced from, edge 32 on the brace 26. An elongated piano hinge 40 is positioned between parallel edges 32 on the brace and 38 on the lifting member, and does not extend to any substantial degree above the adjacent upper per surfaces of parts 26 and 36. One leaf of the two leaves of the piano hipge 40 is secured respectively to the two parts, brace member 26 and lifting member 36, with the uppermost portion of the knuckle of the hinge 42 located substantially in the plane of the adjacent, co-planar, uppermost surface portions of brace 4 and lifting member 36 as is best seen in FIG. 5. The adjacent leaves, or attachment plates, 44 and 46 of the piano hinge are respectively connected to the parallel spaced edges 32 and 38 respectively of the brace member 26 and the lifting member 36. As illustrated in phantom in FIG. 2, the leaves of the piano hinge are attached to their adjacent parts by screws 48 whose heads are countersunk in the leaves of the hinge, so that walls and 40 of brace 26 and lifting member 36 lie closely adjacent each other.

The length of diagonal wall 40 of lifting member 36 is slightly less than the length of wall edge 32 of brace 26, so that lifting member 36 has edges that are congruent with, but slightly smaller than, the polygonal, or triangular-shaped, space 34. The apex of lifting member 36 is rounded as shown at 36*i* in FIG. 2. This leaves a small, substantially uniform width, lateral spacing between the polygonal edges 42 and 44 of the triangular lifting member 36 and the congruent inner surface triangular portion defined by end wall 14 and side wall 18, as clearly shown in FIG. 2. This spacing between the congruent walls of the lifting member 36 and the adjacent walls of the water bed's frame, permits lifting movement of the lifting member 36 as seen in FIG. 3 without interference or rubbing of the edges 42 and 44 of lifting member 36 with the adjacent surrounding walls 14 and 18 of the water bed's frame.

Figure 3:
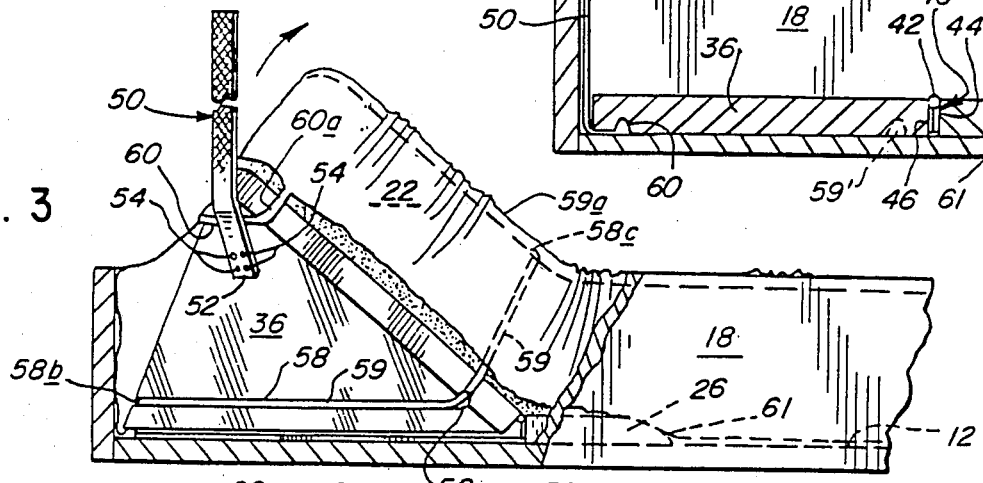
FIG. 3 is a partially cut away, side elevation view of the invention shown in FIG. 2, in which the water mattress raising portion of the apparatus seen in FIG. 2 is shown in a raised position lifting a corner of a water-filled mattress.

In order to provide for selective lifting of the lifting member 36, with the portion of water-filled mattress 22 thereabove, as seen in FIG. 3, the apex portion of member 36, that is spaced distal from brace 26, is provided with an elongated, strap-like, lifting, or pull, member 50 that extends upwardly of member 36 through the lateral spacing bounded by the mattress' confining wall corner defined by the junction of the water bed's upright frame walls 14 and 18, to extend above the uppermost surface of the water bed mattress 22. More specifically, an elongated hand-graspable tongue, or handle, of fabric or other suitable material, designated 50 is of such length that the lower end thereof may, as seen in FIG. 3, be positioned along the apex of intersecting frame walls 14 and 18, with the lower end 52 thereof extending past and under the apex of the triangular lifting part 36 to be secured to the underside of lifting member 36 at a region located about ⅓ of the distance from the apex of triangular part 36 toward its base edge 38.

The lower end 52 of the strap-like pull handle 50 may be secured to part 36 by any appropriate means, such as by gluing, or by staples or nails 54, which hold end 52 of pull-up handle 50 to the underside of part 36. The remainder of handle 50 then runs alongside the bottom of part 36 to the apex of triangular part 36 and then extends freely through the relatively narrow width spacing groove between the apex corner of part 36 and the water mattress portion 22 thereabove, to provide a free, uppermost, handle portion 56 that is positioned to be grasped by the person making up the bed and to be lifted to lift the member 36 and a corner portion of the mattress 22 thereabove, as seen in partial perspective in FIG. 3. The length of handle 50 is selected to be such that the portion 56 thereof will extend above the upper surface of mattress 22 when the water mattress is lying horizontal.

Figure 4:
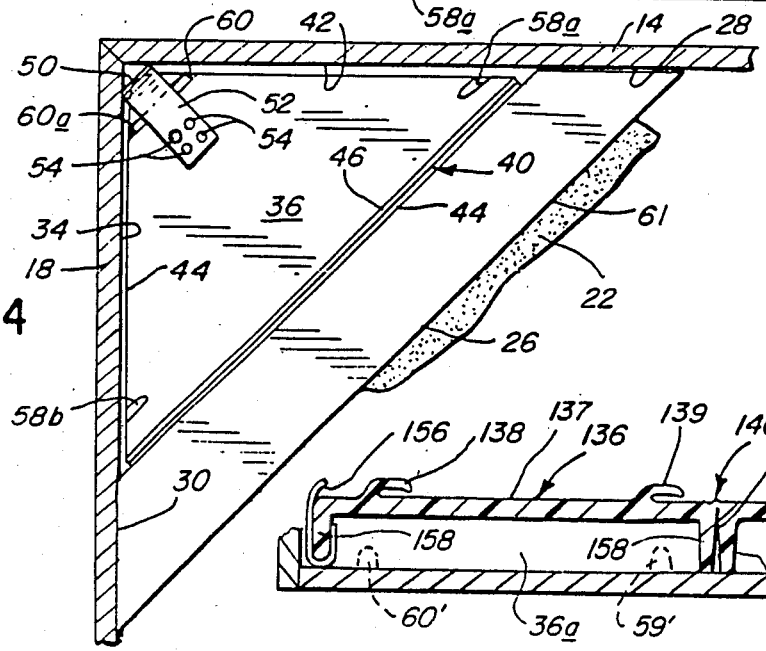
FIG. 4 is a bottom plan view of the form of invention shown in FIGS. 2 and 3, and in which the bottom support of the water bed frame has been partially cut away for clarity, and to show the underside of the corner-located apparatus shown in FIGS. 2 and 3.

The underside of triangular-lifting member 36 is provided with two spaced groove means therein that each lie along a line, or projection of a line, that is substantially parallel to the diagonal edge 38 of lifting member 36. A first groove means consisting of at least aligned notches 58*a* and 58*b* is formed on an imaginary line 58 that extends across the width of triangular part 36, along a path parallel to diagonal edge 38 and spaced from edge 38 in the direction toward the free tip of the triangular member 36. The groove means 58 may be in the form of two notches 58*a* and 58*b* spaced closely adjacent diagonal wall 38 as seen in FIG. 4, or may be in the form of a continuous groove 58 (not shown in FIG. 4). A second groove means 60 that is parallel to but spaced from edge 38, is a continuous groove located adjacent to, but spaced from, the apex of triangular lifting member 36, and may run across the width of member 36. Both the groove means 58, formed by notches 58*a* and 58*b*, and the groove means 60 are adapted to receive and hold therein portions of a retaining string, or elastic cord, that extends from a sheet or cover, as is known in the art of sheets and covers. The second groove means 60 may, as shown, be overlain by a portion of the fabric handle means 50, which operates to hold a resilient cord 60*a* of the bed sheet 59*a* in groove means 60. The notches 58*a* and 58*b* are also adapted to receive a retaining string, or elastic cord, 59 that extends from an undercover, or pad, 58*c* that is positioned between the outer bed sheet 59*a* and the upper surface of the water bed mattress. The cords 60*a* and 59 may be easily entered into, or removed from, their respective notches and grooves when the lifting member 36 is in the raised position shown in FIG. 3.

The two parts 26 and 36 may be formed of any appropriate material, but in the specific form shown is formed of wood. The upper side of brace 26, that is furthest from a corner of the side frame for the water bed mattress, is rounded as shown at 61 to avoid a sharp corner and to provide a rounded ramp against which the underside of the water mattress 22 abuts, as seen in FIGS. 3 and 5.

It will be understood from the foregoing that when the water bed mattress is to be made up, each corner of the water bed mattress is handled in the same way, so that description of the handling of the corner shown in FIG. 3 will be described and will be understood to serve to inform how the mattress is dressed.

The bed pad 58*c* and bed sheet 59*a* are laid in that order, or sequence, over the upper side of the mattress 22. The first corner lifting member 36 is raised by pulling up on the upper end of strap 56 as seen in FIG. 3. The attaching or fastening cord, or string 59 of the mattress' pad is then entered into notches 58*a* and 58*b*, which operates to hold the pad in aligned position with the corner of mattress 22. Then a similar fastening or attaching cord 60*a* from the bed sheet 59*a* is entered into groove 60, and the first corner of mattress 22 is lowered to the position seen in FIG. 5.

The same procedure as above described is repeated for each of the four corners of the water mattress 22, and the bed pads and sheets are thereby secured in position.

Figure 6:
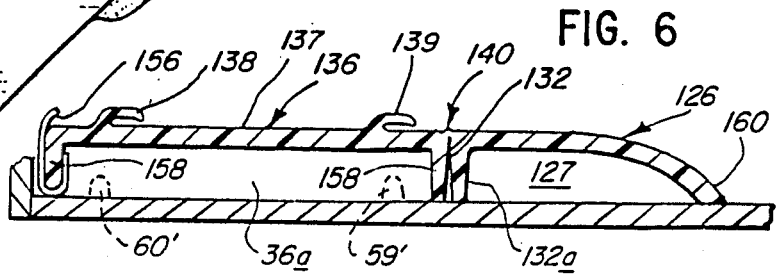
FIG. 6 is a cross-sectional view similar to that shown in FIG. 5, but showing a first alternate embodiment of the invention.

In a first modified form of construction shown in FIG. 6, instead of using solid wood parts 26 and 36 as shown in FIGS. 2–5, the corner construction is formed of shell-like molded plastic members, whose interiors 127 and 136*a* are hollowed out to reduce use of material, with the brace member 126 being shown as a molded body with a hollow underside 127, and the inclined ramp 160 having a larger radius of curvature than shown for the ramp 61 in FIG. 5. Instead of using a piano hinge 40, the diagonal end 132 of brace member 126 is formed on a vertical leg 132*a* whose diagonal length corresponds with the length of side 32 of the brace 24 shown in FIGS. 1–5. Instead of a piano hinge 40, the brace member 24 is joined by a flexible molded plastic joint 140 to a molded triangular lifting member 136 illustrated in FIG. 6.

The lower end of a lifting strap 156 is shown in fragment and is attached to a vertically extending leg portion 158 which extends downwardly from the upper surface of the generally triangular mattress lifter 136 with hollowed out interior 136*a*. The peripheral shape of the triangular lifter 136 provides an upper support wall 137 for a water bed mattress 22, and downwardly extending support walls 158 along the periphery of triangular part 137, to provide support for mattress 22 similar to that provided by triangular wood piece 36, but using a shell of plastic instead, and using a diagonal, plastic, flexible joint 140. The retainers for the retaining cords 60 and 59 of the sheet and bed pad may be in the form of cutouts or openings 60' and 59' provided in the lower edge of hollow part 136.

Alternatively, molded hooks 138 and 139 extending above support surface 137 may be provided for hooking elastic strips 59 and 60*a* thereto, with said hooks pointing in a direction away from the apex of the member 136 and the corner of the frame into which the apex of member 136 fits.

Figure 7:
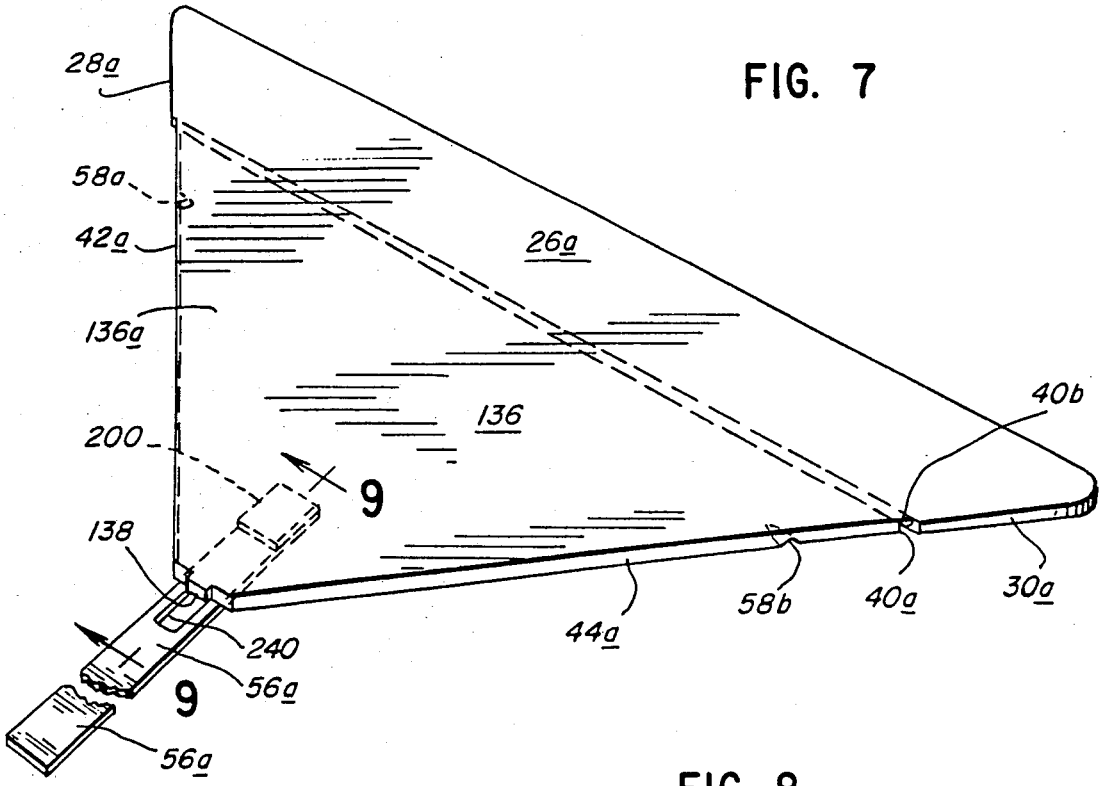
FIG. 7 is a perspective view showing a second alternate embodiment of the invention in which the brace and support portions of the device of FIGS. 2–4 are formed from a single flat sheet of plastic.
Figure 8:
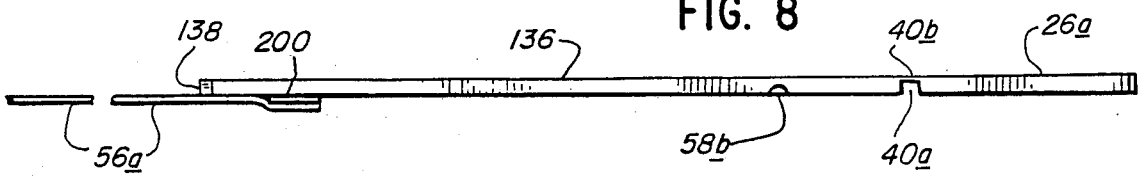
FIG. 8 a side elevation view of the second alternate embodiment shown in FIG. 7.
Figure 9:
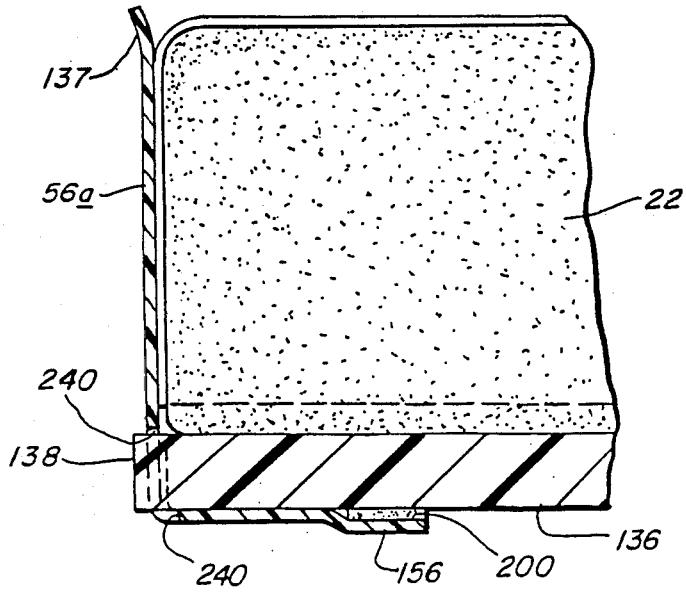
FIG. 9 is an enlarged, fragmentary cross-sectional view showing a portion of the embodiment of the apparatus of FIG. 7 and 8, and illustrating a greatly enlarged cross-sectional view taken substantially on line 9—9 of FIG. 7, and showing how the lifting strap will be positioned relative to the portion of a water-filled mattress lying above the lifting member, and illustrating the flexible lifting strap in its raised position adjacent an end portion of the water-filled mattress.

In a third alternate form of construction shown in FIGS. 7–9, a generally triangular sheet of originally uniform thickness plastic is shown. That sheet of plastic is shaped and dimensioned to serve the same ends and purposes as the corner appliance 24 shown in FIGS. 2–5. The single sheet of plastic has a brace portion 26*a* of a length to provide beveled edges 28*a* and 30*a*, corresponding in location and purpose to edges 28 and 30 of brace 26 shown in FIG. 2.

The thickness of the sheet of plastic is reduced along a diagonal groove 40*a* to provide a thinned plastic bridging portion, or section 40*b* that is of a thinness and resiliency to easily bend to, in effect, provide the flexible hinge equivalent of hinge 40 shown in FIGS. 2, 4 and 5, by hinge 140 shown in FIG. 6. The triangular part 136 in FIG. 7 with edge portions 42*a* and 44*a* corresponds with the lifter 36 of FIGS. 2–4, with edges that are congruent with, but of lesser length than the inner walls of the lateral sides 14 and 18 of a water bed frame. The strap 56*a* corresponds with lifter strap 56 of FIGS. 2–5. The edges 42*a* and 44*a* are positioned inwardly relative to the brace's edges 28*a* and 30*a* to correspond with edges 42 and 44 of FIG. 2.

Some differences do appear when comparing the construction of FIGS. 7–9 with that of FIGS. 2–5. The strap 56*a* is formed of plastic and the innermost end of strap 56*a* that attaches to the underside of the triangular lifter 136, for lifting the corner of the water bed mattress is shown adhesively secured to the underside of mattress lifter 136*a*, using a pad 200 of double faced adhesive to attach on one surface to the underside of mattress lifter 136 and with the other side of pad 200 being adhesively secured to the attachment end 156 of plastic strap 56*a*. The apex end of generally triangular lifter 136 is truncated and shaped to provide a projecting, rectangular, tongue 138, of less width than strap 56*a* and which is sized to be received into and project through an elongated slot 240 provided in plastic strap 56*a*. That construction and its interrelationship during lifting of the corner of mattress 22 is clearly shown in FIG. 9 where the lifter 56*a* is shown in its upright position with the projecting end 138 of lifter section 136 extending through slot 140 in lifter strap 56*a*, and with the free end 137 of strap 56*a* extending above the upper surface of the water bed mattress 22 to be grasped by the person who is making up the water bed.

While particular embodiments of this invention have been shown and described, it will be obvious to those skilled in the art that various changes and modifications may be made to the structures disclosed herein without departing from the spirit and scope of the invention and, therefore, it is intended in the appended claims to cover all such changes and modifications which fall within the spirit and scope of my invention.

What is claimed is:

1. For use with a water bed construction having an upright water mattress side enclosing frame, with at least one corner frame arrangement, and a water mattress support adjacent the lower end of the upright side frame;

the improvement of a bed make-up appliance for retaining at least one cover member, that is provided with an embracing cord means, for securing the cover member to the top of the water bed mattress in a corner-shaped and tension held arrangement relative to the bed frame's corner frame arrangement and the support for the water bed's mattress; said improvement comprising, in combination:

a corner-located holder for use in a corner of the upright side frame for the water bed's mattress and supported on the mattress' support, said holder including a diagonal brace member positioned on said mattress' support and below the water bed mattress and being of a length to abut two transverse sides of the bed frame's corner defining portion of the bed's side enclosing frame, to define a substantially polygonal space between the brace member and the adjacent corner of said upright side frame;

a polygonal lifting member located below the corner of the water bed's mattress and being hinged to the diagonal edge of the brace member that lies closest to the corner of the side frame;

the shape of said polygonal lifting member being generally congruent with, but of smaller edge size, than the polygonal space between the brace member and the corner of the upright side frame;

an elongated strap-like pull member secured to a portion of the lifting member distally from the brace member, to provide means for selectively raising and pivoting the lifting member about the axis of the hinge connection of the lifting member to the brace member;

and at least one cord holding means provided on the lifting member and adapted to receive therein a portion of a fastening cord provided on a cover member for the water bed mattress.

2. A construction as in claim 1 wherein the brace member and the polygonal lifting member are made of substantially rigid, weight supporting, material; and the hinge between the lifting member and brace member does not extend to any substantial degree above the upper adjacent surfaces of the brace member and lifting member.

3. A construction as in claim 2 wherein the hinge between the lifting member and brace member is an elongated piano hinge with a pair of leaves, one leaf of the hinge being connected to the brace member, and the other leaf of hinge being connected to a side of the lifting member adjacent the brace member.

4. A construction as in claim 2 wherein the brace member and lifting member are molded of plastic and hollowed out, to reduce the quantity of material used therein, and the hinge between the lifting member and brace member is a flexible strip of plastic molded integral with the lifting member and the brace member.

5. A construction as in claim 2 wherein the brace member and the lifting member are formed from a substantially rigid, relatively thin, sheet of plastic of uniform thickness that is substantially triangular in peripheral contour.

6. A construction as in claim 5 wherein the underside of the sheet of plastic has groove means cut therein to define to one side of the groove the brace member, and to the other side of the groove the lifting member, with the plastic bridging portion of the groove being of a thinness and resiliency to provide a flexible hinge between the brace member and the lifting member.

7. A construction as in claim 6 wherein the portion of the mattress lifting member distal from the flexible hinge is formed with a shaped tip, and the elongated strap-like lifting member having a width greater than the shaped tip and a slot cut through the strap-like lifting member to accommodate a cut-out section in the strap that slidably receives the shaped tip of the mattress lifting member therethrough.

8. A construction as in claim 2 wherein hook means for receiving and holding cords extending from surface covering members for the water bed mattress are provided on the upper surface of the polygonal lifting member.

9. A construction as in claim 8 wherein said hook means face in a direction away from the corner of the side frame for the water bed mattress and toward the hinge between the brace member and the polygonal lifting member.

10. A construction as in claim 1 wherein there are at least two transverse groove means provided on the underside of the lifting member and spaced different orthogonal distances from the line of hinging between the lifting member and the brace member, each groove means being adapted to receive a cord-like member extending from a cover sheet laid on the upper surface of the water bed mattress.

11. A construction as in claim 10 wherein the second of the groove means is spaced close to the end of the lifting member that is distal from the line of hinging between the lifting member and the frame member.

12. A construction as in claim 11 wherein the strap-like pull member is secured to the underside of the lifting member at a position where the strap-like lifting member overlies the second of the groove means and any cord-like member located in the groove means distal of the line of hinging between the lifting member and the brace member.

13. A construction as in claim 1 wherein the lifting member is congruent with, but of smaller edge size than the polygonal space defined by the corner of the upright edge frame to provide a spacing therebetween of a dimension through which the elongated strap-like pull member may freely extend.

14. A construction as in claim 1 wherein the shape of the polygonal lifting member, at its end furthermost from the hinge connected to the brace member, is rounded.

15. A construction as in claim 1 wherein when the lifting member is in its lifted position, the embracing cord means may be selectively disengaged from the groove means on the lifting member.

16. A construction as in claim 1 wherein the cord holding means are transverse groove means provided on the underside of the lifting member.

* * * * *